US007715778B2

(12) United States Patent
Sugimoto

(10) Patent No.: US 7,715,778 B2
(45) Date of Patent: May 11, 2010

(54) CLEANING BLADE FOR USE IN IMAGE-FORMING APPARATUS

(75) Inventor: Mutsuki Sugimoto, Hyogo (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 639 days.

(21) Appl. No.: 11/714,811

(22) Filed: Mar. 7, 2007

(65) Prior Publication Data

US 2007/0212137 A1 Sep. 13, 2007

(30) Foreign Application Priority Data

Mar. 8, 2006 (JP) ..... 2006-062858
Mar. 22, 2006 (JP) ..... 2006-079593

(51) Int. Cl.
*G03G 21/00* (2006.01)

(52) U.S. Cl. ..... 399/350; 399/71; 399/123; 399/110; 399/343; 15/256.5; 15/256.52

(58) Field of Classification Search ..... 399/38, 399/71, 107, 110, 123, 343, 349, 350, 351, 399/353, 354; 15/256.5, 256.51, 256.52
See application file for complete search history.

(56) References Cited

U.S. PATENT DOCUMENTS

| | | | | |
|---|---|---|---|---|
| 5,162,858 | A * | 11/1992 | Shoji et al. | 399/350 |
| 5,765,088 | A | 6/1998 | Nakayama et al. | |
| 6,128,462 | A * | 10/2000 | Kato et al. | 399/350 |
| 2004/0110366 | A1* | 6/2004 | MacKay et al. | 438/613 |
| 2004/0136763 | A1 | 7/2004 | Murakami et al. | |
| 2007/0286653 | A1* | 12/2007 | Watanabe et al. | 399/350 |
| 2008/0080914 | A1* | 4/2008 | Sugimoto | 399/350 |

FOREIGN PATENT DOCUMENTS

| | | | |
|---|---|---|---|
| EP | 0 775 564 | A2 | 5/1997 |
| JP | 6-230710 | A | 8/1994 |
| JP | 9-141761 | A | 6/1997 |
| JP | 10-39707 | | 2/1998 |
| JP | 11-105044 | A | 4/1999 |
| JP | 2001-117358 | A | 4/2001 |
| JP | 2003-226773 | | 8/2003 |
| JP | 2003-248404 | A | 9/2003 |
| JP | 2005-37852 | A | 2/2005 |
| JP | 2005-309404 | | 11/2005 |
| JP | 2005-321533 | | 11/2005 |

* cited by examiner

*Primary Examiner*—David P Porta
*Assistant Examiner*—Jessica L Eley
(74) *Attorney, Agent, or Firm*—Birch, Stewart, Kolasch & Birch, LLP

(57) ABSTRACT

A cleaning blade, for use in an image-forming apparatus, for removing toner which remains on a surface of a photoreceptor drum thereof, with the cleaning blade in contact with the photoreceptor drum. The cleaning blade is formed from a sheet composed of a thermosetting elastomer composition. The roughness degree of a ridgeline formed longitudinally on a cleaning blade edge which contacts the photoreceptor is set to not more than 10 μm. The straightness degree of the ridgeline is set to not more than 100 μm. In a test of supplying 150,000 sheets of paper conducted by mounting the cleaning blade on the image-forming apparatus, a change rate ΔRe of an average roughness degree value Re of the ridgeline formed longitudinally on the edge is set to not more than +0.7, and a sectional length Ws45 of a wear surface of the edge, inclined at 45 degrees, which contacts the photoreceptor is set to not more than 50 μm.

9 Claims, 4 Drawing Sheets

CLEANING BLADE FOR USE IN IMAGE-FORMING APPARATUS

This nonprovisional application claims priority under 35 U.S.C. §119(a) on Patent Application No(s). 2006-062858 and 2006-079593 filed in Japan on Mar. 8, 2006 and Mar. 22, 2006, respectively, the entire contents of which are hereby incorporated by reference.

FIELD OF THE INVENTION

The present invention relates to a cleaning blade for use in an image-forming apparatus and a method for manufacturing the cleaning blade. More particularly the present invention is intended to improve the cleaning performance of the cleaning blade in removing toner which remains on the surface of a photoreceptor by enhancing the accuracy of its ridgeline which contacts the photoreceptor and maintain the cleaning performance thereof for a long time by decreasing the degree of wear of an edge thereof.

In an electrostatic photocopying machine in which ordinary paper is used as recording paper, a copying operation is performed as follows: an electrostatic charge is applied to the surface of a photoreceptor by discharge, an image is exposed to form an electrostatic latent image on the photoreceptor, toner having an opposite polarity is attached to the electrostatic latent image to develop the electrostatic latent image, a toner image is transferred to recording paper, and the recording paper to which the toner image has been transferred is heated under pressure to fix the toner to the recording paper. Therefore to sequentially copy the image of an original document on a plurality of sheets of recording paper, it is necessary to remove the toner which has remained on the surface of the photoreceptor after the toner image is transferred to the recording paper in the above-described processes.

As a method for removing the toner which has remained on the photoreceptor, a cleaning method of removing toner by sliding a cleaning blade in contact with the surface of the photoreceptor, with the cleaning blade being pressed against the surface of the photoreceptor is known.

The conventional cleaning blade used in the above-described cleaning method is composed of polyurethane rubber to remove pulverized toner or deformed polymerized toner present on the photoreceptor.

The cleaning blade composed of the urethane rubber has a low heat resistance. Thus its edge having an important role for removing the toner wears and rounds because of friction between it and the photoreceptor. Consequently the cleaning blade deteriorates in its cleaning performance and is incapable of removing the toner.

The conventional cleaning blade composed of the urethane rubber is capable of cleaning the conventional pulverized toner or the deformed polymerized toner, even though the pressure of the edge of the cleaning blade to be applied to the photoreceptor at the contact portion between the edge and the photoreceptor (hereinafter referred to as line pressure) is low. Such being the case, a material having a wear resistance superior to that of the polyurethane rubber has not been developed.

The present tendency is to save energy, reduce the cost of the image-forming apparatus, and form a high-quality image. That being the case, toner having a small diameter and spherical polymerized toner have been developed. As a result, unless the line pressure of the edge of the cleaning blade to be applied to the photoreceptor at the contact portion therebetween is increased, it is difficult to remove toner that has remained on the surface of the photoreceptor. Thereby the toner is apt to be removed imperfectly.

When the line pressure of the edge of the cleaning blade composed of the polyurethane rubber to be applied to the photoreceptor at the contact portion therebetween is increased, the frictional force becomes large, and thus the edge of the cleaning blade wears excessively, and further the roughness degree of a ridgeline of the edge deteriorates. Therefore it is very difficult to increase the line pressure of the edge of the cleaning blade composed of the polyurethane rubber.

The conventional cleaning blade made of the polyurethane rubber wears to a minimum at its edge owing to an excellent wear resistance thereof. But the excellent wear resistance causes the edge to wear nonuniformly in the longitudinal direction of the cleaning blade. When the ridgeline of the edge wears nonuniformly, the toner collects in the neighborhood of an unworn portion of the edge. Thereby an excessive stress concentrates locally on the edge. Consequently the stress-concentrated region is destroyed. As a result, when 150,000 sheets of paper are supplied to an image-forming apparatus, the cleaning blade is incapable of maintaining a preferable cleaning performance.

The cleaning apparatus disclosed in Japanese Patent Application Laid-Open No. 2005-37852 (patent document 1) has been developed to effectively remove toner and a foreign matter present on the image-carrying member or on the recording member-supporting member of the image-forming apparatus in which the small-diameter toner and the spherical polymerized toner are used. The cleaning apparatus has the abrading first and second blades having the layer composed of the elastic material containing abrasive grains.

The cleaning function of the cleaning blade disclosed in the patent document 1 is performed by the action of the abrasive grains. When the abrasive grains drop from the abrading blade, the cleaning function of the cleaning blade deteriorates. Further there is a possibility that the abrasive grains damage the surface of the photoreceptor.

The cleaning blade for use in the image-forming apparatus is manufactured by molding a material into a rubber sheet, cutting the rubber sheet rectangularly with a cutter, and bonding it to a holder. Finally the cleaning blade produced in this procedure undergoes an examining step. To produce the cleaning blade having a high performance and a high accuracy by cutting the rubber sheet with a cutting blade, the step of cutting the rubber sheet to form the ridgeline of a cut surface which contacts the surface of the photoreceptor is the most important step.

In a conventional cutting step, the rubber sheet is cut by merely traversing the cutting blade. But friction always occurs between the cutting blade and the rubber sheet, when the rubber sheet is cut. Thus the ridgeline of the rubber sheet is damaged and is hence an accurate ridgeline cannot be obtained. The cutting blade generates a stress in the cutting operation. Thus the rubber sheet is cut with a low accuracy owing to vibration of the cutting blade, and further abrasion progresses owing to the friction between the rubber sheet and the cutting blade. When the cutting blade cuts the rubber sheet 10 to 100 times per day, the cutting blade deteriorates in its performance. Therefore it is necessary to replace the cutting blade frequently, which deteriorates the production efficiency. If an operator does not find that the cutting blade has deteriorated in its performance, the rubber sheet is cut with a very low accuracy in forming the ridgeline.

To solve the above-described problems, the method for manufacturing the following cleaning blade is proposed.

For example, in the cleaning blade disclosed in Japanese Patent Application Laid-Open No. 6-230710 (patent document 2), after the supporting fitting is formed from the steel plate, the rubber sheet for use in the cleaning blade is bonded to the supporting fitting. After the rubber sheet is placed in position, it is cut to form the ridgeline.

But the cutting blade is descended by a press machine at a very low speed (cutting speed) in cutting the rubber sheet to form a ridgeline. Further the rubber sheet is cut while it is deforming. Thus this method is incapable of providing a ridgeline having a high accuracy. The method for cutting the rubber sheet to form the ridgeline by moving the cutting blade is also proposed in the patent document 2. When the rubber sheet is cut curvedly on the blade-receiving base, a stress is generated at the upper portion of the rubber sheet in the stretching direction. Thus the rubber sheet can be cut easily. But a stress is generated at the lower portion of the rubber sheet in the compression direction. As a result, a strong stress and a strong friction force are applied to the cutting blade. Consequently the cutting blade vibrates and the rubber sheet wears. Thereby it is impossible to obtain a ridgeline having a high accuracy.

Patent Document 1

Japanese Patent Application Laid-Open No. 2005-37852

Patent Document 2

Japanese Patent Application Laid-Open No. 6-230710

SUMMARY OF THE INVENTION

The present invention has been made in view of the above-described problems. Therefore it is an object of the present invention to provide a cleaning blade allowed to have an improved performance in removing toner which remains on the surface of a photoreceptor by decreasing the roughness degree of a ridgeline and the straightness degree thereof and maintain the cleaning performance for a long time by improving the wear resistance of an edge thereof which contacts a photoreceptor.

It is another object of the present invention to provide a method for manufacturing the cleaning blade allowed to have a high-accuracy ridgeline formed on the edge thereof by preventing an excessive stress from being generated on the cutting blade and decreasing the degree of friction between the rubber sheet and the cutting blade when the rubber sheet is cut with the cutting blade.

To solve the above-described problems, the present invention provides a cleaning blade, for use in an image-forming apparatus, for removing toner which remains on a surface of a photoreceptor drum thereof, with the cleaning blade in contact with the photoreceptor drum. The cleaning blade is formed from a sheet composed of a thermosetting elastomer composition. The roughness degree of a ridgeline formed longitudinally on a cleaning blade edge which contacts the photoreceptor is set to not more than 1 μm. The straightness degree of the ridgeline is set to not more than 100 μm. In a test of supplying 150,000 sheets of paper conducted by mounting the cleaning blade on the image-forming apparatus, a change rate ΔRe of an average roughness degree value Re of the ridgeline formed longitudinally on the edge is set to not more than +0.7, and a sectional length Ws45 of a wear surface of the edge, inclined at 45 degrees, which contacts the photoreceptor is set to not more than 50 μm.

The reason the upper limit of the roughness degree of the ridgeline of the edge is set to 10 μm is as follows: If the roughness degree of the ridgeline of the edge is above 10 μm, toner having a diameter below 5 μm leaks from convexities and concavities of the ridgeline. Thus the cleaning blade has a low cleaning performance. The lower limit of the roughness degree of the ridgeline is not specifically limited. Although it is preferable that the lower limit of the roughness degree of the ridgeline is set as small as possible, normally the lower limit of the roughness degree of the ridgeline is 1 μm.

It is more favorable to set the roughness degree of the ridgeline to nor more than 8 μm.

The roughness degree of the ridgeline is determined by the following method:

By using a ridgeline-examining apparatus, the ridgeline of a cut plane of a molded product is scanned at an angle of 45° by a CCD camera. The difference between the dimension of convexities formed on the ridgeline and that of concavities formed thereon is computed for each 1 mm of the ridgeline having a length of 326 mm by means of image processing. The roughness degree of the ridgeline is determined from an average value of 326 data of the difference between the dimension of the convexities and that of the concavities.

The straightness degree of the ridgeline is set to not more than 100 μm. If the straightness degree is above 100 μm, a contact pressure generated at one end of the cleaning blade is different from that generated at the other end thereof. Thereby the cleaning blade has a low cleaning performance. The lower limit of the straightness degree is not specifically limited. Although it is preferable that the lower limit of the straightness degree is set as small as possible, it is preferable to set the straightness degree to not more than 80 μm. It is normal to set the straightness degree to about 10 μm.

The straightness degree is determined from the 326 data obtained at each 1 mm of the ridgeline having the length of 326 mm. More specifically, as shown in FIG. 5, a line connecting a start point and termination point of a locus 40 of a waveform of the ridgeline is an ideal straight line 41. An absolute value of the maximum and minimum of a vertical distance from the ideal straight line 41 to the locus 40 of the waveform is a straightness degree 42.

In the test of supplying 150000 sheets of paper to the image-forming apparatus, the change rate ΔRe of the average roughness degree value Re of the ridgeline longitudinally formed on the edge is set to favorably not more than +0.7 and more favorably not more than +0.5.

A shift of the change rate ΔRe to a minus side indicates that the roughness degree of the ridgeline has become smaller than an initial average roughness degree value Re of the ridgeline. A shift of the change rate ΔRe to a positive side indicates that the roughness degree of the ridgeline has become larger than the initial average roughness degree value Re. If the change rate ΔRe is set above +0.7, there is a fear that toner is defectively removed from the surface of the photoreceptor.

The change rate of the average roughness degree value Re of the ridgeline is determined by the following method:

By using the ridgeline-examining apparatus, the edge of the cleaning blade is scanned at an angle of 45° by a CCD camera. The difference between the dimension of convexities formed on the ridgeline and that of concavities formed thereon is computed for each 1 mm of the edge by means of image processing. The roughness degree of the ridgeline having the length of 326 mm is determined from the average value of 326 data of the difference between the dimension of the convexities and that of the concavities. The change rate ΔRe of the average roughness degree value Re of the ridgeline is computed from an average roughness degree value Re' of the ridgeline by using the condition equation after 150000 sheets of paper is supplied to the image-forming apparatus.

The sectional length Ws45 of the wear surface of the cleaning blade edge inclined at 45 degrees is set to not more than 50 μm and favorably not more than 30 μm. It is favorable that the sectional length Ws45 of the wear surface of the edge is close to zero, but normally not less than 1 μm.

That the sectional length of the wear surface of the edge is below 1 μm means that the thermosetting elastomer composition does not wear, which does not actually occur. Therefore the sectional length of the wear surface of the edge is set above 1 μm. If the upper limit of the sectional length of the wear surface of the edge is set above 50 μm, the edge wears excessively. Thereby there is a fear that the cleaning blade has a defective cleaning performance.

The sectional length Ws45 of the wear surface of the edge after 150000 sheets of paper is supplied to the image-forming apparatus is measured by using the following method:

A cleaning blade, having a thickness of 2 mm and an appropriate size, which is obtained by punching a sheet composed of the thermosetting elastomer composition is bonded to a supporting member. Thereafter the cleaning blade is mounted on an image-forming apparatus (printer commercially available) with the cleaning blade in contact with the photoreceptor. An original document is printed on 150,000 sheets of paper by rotating the photoreceptor at a rotational speed of 200 mm/second to 500 mm/second, a normal temperature of 23° C., a relative humidity of 55%, and a printing concentration of 4%. Thereafter the edge of the cleaning blade is observed.

With reference to FIG. 1A, a crosshatched portion shows a worn portion of the rubber of the cleaning blade. A sectional length Ws (23*a*) of the wear surface is the length of an inclined surface formed by connecting an end of a wear width Wc (23*b*) which is the widthwise wear length of an edge of a rubber 23 of the cleaning blade and an end of a wear depth Wm (23*c*) which is the depth-direction wear length of the edge of the rubber 23 thereof to each other. As shown in FIG. 1B, the sectional length Ws45 (24) of the wear surface is measured as a horizontal distance of the sectional length Ws of the wear surface of the edge inclined at 45 degrees.

It is favorable that the ratio Tb/Ta of an amount of the toner (amount of toner Tb after toner passes cleaning blade) which remains on a unit area of the photoreceptor of the image-forming apparatus after the toner is removed by the cleaning blade to an amount of the toner (amount of toner Ta before toner passes cleaning blade) supplied to the unit area of the photoreceptor is not more than 0.5. It is more favorable that the ratio Tb/Ta is not more than 0.4.

That the ratio Tb/Ta indicating the cleaning performance is zero means that the cleaning blade has removed all toner present on the photoreceptor. That is, the cleaning blade has the most favorable cleaning performance. The ratio Tb/Ta is set to not more than 0.5 for the reason described below. If the ratio Tb/Ta indicating the cleaning performance is above 0.5, a large amount of toner passes the cleaning blade without being removed by the cleaning blade. Thus there is a fear that a printed image is adversely affected.

The cleaning performance is evaluated by the following method:

A cleaning blade, having a thickness of 2 mm and an appropriate size, which is obtained by punching a sheet composed of the thermosetting elastomer composition is bonded to a supporting member. Thereafter the cleaning blade is mounted on the image-forming apparatus (printer commercially available) with the cleaning blade in contact with the photoreceptor. The photoreceptor was rotated at a rotational speed of 200 mm/second to 500 mm/second under the condition of a normal temperature of 23° C. and a relative humidity of 55%. As described above, after the amount of toner supplied to the photoreceptor per unit area is computed (toner amount Ta before toner passes cleaning blade without being removed by cleaning blade), the photoreceptor is rotated to remove the toner by the cleaning blade. Thereafter the amount of the toner (toner amount Tb after toner passes cleaning blade without being removed by cleaning blade) present on the surface of the photoreceptor disposed rearward from the cleaning blade is converted into an amount per unit area of the photoreceptor. Thereafter a value indicating the cleaning performance of the cleaning blade is evaluated from the condition equation.

It is preferable that the thermosetting elastomer composition contains a rubber component, a filler, and a crosslinking agent and that the thermosetting elastomer composition has a tensile strength of 14 to 35 MPa, a tear strength of 25 to 80 N/mm, and a volume swell of 85 to 160%.

The tensile strength, tear strength, and volume swell of the thermosetting elastomer composition are measured in accordance with the JIS standard described below.

(1) Tensile strength: A dumbbell specimen No. 3 is made by punching a prepared sheet having a thickness of 2 mm to measure the tensile strength thereof at a stress rate of 500 mm/minute in accordance with JIS K 6251.

(2) Tear strength: An angle specimen is made by punching a prepared sheet having a thickness of 2 mm to measure the tear strength thereof in accordance with JIS K 6252.

(3) Volume swell: The volume swell of a specimen sheet having a dimension of 20 mm×20 mm×2 mm is computed by means of toluene swelling at 40° C. for 24 hours in accordance with JIS K 6258.

It is preferable that the rubber component of the thermosetting elastomer composition includes acrylonitrile-butadiene rubber (NBR), acrylonitrile-butadiene rubber into which a carbonyl group is introduced, hydrogenated acrylonitrile-butadiene rubber (HNBR), hydrogenated acrylonitrile-butadiene rubber into which a carbonyl group is introduced, natural rubber (NR), butadiene rubber (BR), styrene-butadiene rubber (SBR), isoprene rubber (IR), butyl rubber (IIR), chloroprene rubber (CR), acrylic rubber (ACM, ANM), epichlorohydrin rubber (ECO), ethylene propylene rubber (EPR), and ethylene-propylene-diene copolymer rubber (EPDM). These rubber components may be used singly or by mixing two or more of them with each other.

When two kinds of rubbers are mixed with each other, it is preferable that the mixing amount of one (rubber A) of them is favorably not less than 50 parts by mass nor more than 90 parts by mass and more favorably not less than 70 parts by mass nor more than 90 parts by mass and that the mixing amount of the other rubber (rubber B) is favorably not less than 10 parts by mass nor more than 50 parts by mass and more favorably not less than 10 parts by mass nor more than 30 parts by mass with respect to the total mass (100 parts by mass) of the rubber component.

The reason the mixing amount of the rubber A is set to not less than 50 parts by mass nor more than 90 parts by mass is as follows: If the mixing amount of the rubber A is set below 50 parts by mass, there is a fear that the thermosetting elastomer composition has a low physical strength. On the other hand, if the mixing amount of the rubber A is set above 90 parts by mass, there is a fear that the rubber B does not display its performance.

The reason the mixing amount of the rubber B is set to not less than 10 parts by mass nor more than 50 parts by mass is as follows: If the mixing amount of the rubber B is set below 10 parts by mass, there is a fear that the rubber B does not display its performance. On the other hand, if the mixing amount of the rubber B is set above 50 parts by mass, there is a fear that the thermosetting elastomer composition has a low physical strength based on the rubber A.

When two kinds of rubbers A and B are used as the rubber component, it is optimum that the rubber A consists of NBR or hydrogenated acrylonitrile-butadiene rubber (HNBR). The rubber A consists of the NBR or the hydrogenated acrylonitrile-butadiene rubber contained at favorably not less than 50 parts by mass and at more favorably not less than 70 parts by mass with respect to the entire rubber component. It is most favorable to use the hydrogenated acrylonitrile-butadiene rubber (HNBR) having residual double bonds below 10% as the rubber component of the thermosetting elastomer composition.

It is preferable that the acrylonitrile-butadiene rubber, the acrylonitrile-butadiene rubber into which the carbonyl group is introduced or the hydrogenated acrylonitrile-butadiene rubber is used as the rubber component; and hydrogenated acrylonitrile-butadiene rubber in which zinc methacrylate is finely dispersed or methacrylic acid is mixed with the rubber component.

As described above, the cleaning blade of the present invention is composed not of the polyurethane rubber which is a thermosetting resin used for many conventional cleaning blades, but of the acrylonitrile-butadiene rubber, the hydrogenated acrylonitrile-butadiene rubber or the acrylonitrile-butadiene rubber having the carbonyl group introduced thereinto.

The polyurethane rubber conventionally used has a high crosslinking density and a high wear resistance against a high-speed and large deformation, but a nonuniform crosslinking density. Thus polyurethane rubber causes the cleaning blade to be worn nonuniformly at its edge.

On the other hand, the acrylonitrile-butadiene rubber and the hydrogenated acrylonitrile-butadiene rubber used as the rubber component in the present invention have properties that they have a high tensile strength, tear strength, and resistance to fracture. To improve the nonuniformity of the crosslinking density of the polyurethane rubber and allow the edge of the cleaning blade to be worn uniformly, the acrylonitrile-butadiene rubber and the hydrogenated acrylonitrile-butadiene rubber having a low crosslinking density than the polyurethane rubber are used, because they have a uniform crosslinking density.

By allowing the edge of the cleaning blade to be worn uniformly, stress concentration does not occur unlike the conventional cleaning blade made of the polyurethane. Therefore the cleaning blade is allowed to have preferable cleaning performance for as many as 150000 sheets of paper supplied to the image-forming apparatus.

When the acrylonitrile-butadiene rubber (NBR) or the hydrogenated acrylonitrile-butadiene rubber (HNBR) is used as the rubber component of the thermosetting elastomer compositions, it is especially preferable to use the hydrogenated acrylonitrile-butadiene rubber (HNBR) having residual double bonds below 10%. As the NBR or the NBR which is used as the material of the HNBR, it is possible to use any of low-nitrile NBR, intermediate-nitrile NBR, moderate high-nitrile NBR having the bound acrylonitrile amount of 31% to 35%, high-nitrile NBR having the bound acrylonitrile amount of 36% to 42%, and extremely high nitrile NBR. It is preferable to use the moderate high-nitrile NBR having the bound acrylonitrile amount of 31% to 35% and the high-nitrile NBR having the bound acrylonitrile amount of 36% to 42%. The hydrogenated acrylonitrile-butadiene rubber conventionally used is used in the present invention. It is preferable that the bound acrylonitrile amount of the hydrogenated acrylonitrile-butadiene rubber is 17% to 50%.

By finely dispersing the zinc methacrylate to a high extent in the hydrogenated acrylonitrile-butadiene rubber, owing to the co-crosslinking effect of the zinc methacrylate, the zinc methacrylate makes a graft polymerization reaction at a crosslinking time to form a fine structure. Thus the resulting thermosetting elastomer composition has a higher mechanical property than the conventional thermosetting elastomer composition reinforced with the carbon black. Thereby the thermosetting elastomer composition has an improved wear resistance. Therefore the cleaning blade of the present invention is excellent in the performance of removing toner having a small diameter and spherical polymerized toner. As the zinc methacrylate, it is possible to use a zinc methacrylate, or a mixture of methacrylic acid and zinc oxide.

As the hydrogenated acrylonitrile-butadiene rubber in which the zinc methacrylate is finely dispersed to a high extent, it is possible to use a commercially available product. For example, "Zeoforte ZSC series" produced by Zeon Corporation is used.

It is preferable that 90 to 30 parts by mass of the acrylonitrile-butadiene rubber, the acrylonitrile-butadiene rubber into which the carbonyl group is introduced or the hydrogenated acrylonitrile-butadiene rubber and 10 to 70 parts by mass of hydrogenated acrylonitrile-butadiene rubber in which the zinc methacrylate is finely dispersed to a high extent are mixed with the rubber component.

The thermosetting elastomer composition composing the image-forming apparatus of the present invention for use in the image-forming apparatus contains the above-described rubber component, a rubber component containing the hydrogenated acrylonitrile-butadiene rubber in which the zinc methacrylate is finely dispersed to a high extent as necessary, the filler, and the crosslinking agent, as described above.

It is preferable that 0.1 to 80 parts by mass of the filler and 0.1 to 30 parts by mass of the crosslinking agent are mixed with 100 parts by mass of the rubber component; the filler is not less than one kind selected from among a co-crosslinking agent, a vulcanization accelerator, a vulcanization-accelerating assistant, an age resistor, a softener for rubber, a reinforcing agent, and other kinds of additives; and the crosslinking agent is not less than one kind selected from among sulfur, an organic sulfur-containing compound, an organic peroxide, a heat-resistant crosslinking agent and a resin crosslinking agent.

Unlike the thermosetting resin such as the polyurethane used in many conventional cleaning blades for use in the image-forming apparatus, the thermosetting elastomer composition constructing the cleaning blade of the present invention for use in the image-forming apparatus is allowed to have various properties by altering the mixing ratio among the rubber component, the filler, and the crosslinking agent.

That is, by adjusting the coefficient of friction of the thermosetting elastomer to a low value, it is possible to avoid the occurrence of the conventional problem, namely, an inverse phenomenon of the edge of the cleaning blade when the edge contacts the photoreceptor owing to a high coefficient of friction. Further by controlling the vibration-damping property of the thermosetting elastomer composition, it is possible to restrain a noise-making phenomenon which from occurring when the edge contacts the photoreceptor. By adjusting the elasticity of the thermosetting elastomer composition to a proper degree, it is also possible to press the cleaning blade against the photoreceptor at a large force. Thereby it is possible to securely remove residual spherical fine toner.

It is preferable to mix 0.1 to 80 parts by mass of the filler with 100 parts by mass of the rubber component. If the mixing amount of the filler is below 0.1 parts by mass, there is a fear that the rubber component is not sufficiently reinforced or vulcanized. If the mixing amount of the filler is above 80 parts by mass, the hardness of the thermosetting elastomer composition is so high that there is a fear the cleaning blade of the present invention may damage a photoreceptor It is preferable that the mixing amount of the crosslinking agent is set to 0.1 parts by mass to 30 parts by mass with respect to 100 parts by mass of the rubber component for the following reason: When the mixing amount of the crosslinking agent is less than 0.1 parts by mass, the vulcanizing density becomes small and there is a fear that the thermosetting elastomer composition is not provided with a desired property. On the other hand, the mixing amount of the crosslinking agent exceeds 30 parts by mass, owing to an excessive crosslinking reaction, the hardness of the thermosetting elastomer composition is so high that there is a fear the cleaning blade of the present invention may damage the photoreceptor.

As a filler for use in the present invention, a co-crosslinking agent, a vulcanization accelerator, a vulcanization-accelerating assistant, an age resistor, a softener for rubber, a reinforcing agent, and other kinds of additives are listed. These fillers are used singly or by mixing two or more thereof with each other.

The co-crosslinking agent crosslinks itself and reacts with rubber molecules to crosslink them, thus making the entire elastomer composition polymeric.

As the co-crosslinking agent, it is possible to use ethylene unsaturated monomers represented by methacrylate ester and metal salts of methacrylic acid or acrylic acid; polyfunctional polymers utilizing a functional group of 1,2-polybutadiene; and dioximes.

As the ethylene unsaturated monomer, the following substances are listed:

(a) Monocarboxylic acids such as acrylic acid, methacrylic acid, crotonic acid, and the like.

(b) Dicarboxylic acids such as maleic acid, fumaric acid, itaconic acid, and the like.

(c) Ester or anhydride of the above-described (a) and (b)

(d) Metal salts of the above-described (a) through (c)

(e) Aliphatic conjugated dienes such as 1,3-butadiene, isoprene, 2-chloro-1,3-butadiene, and the like (f) Aromatic vinyl compounds such as styrene, α-methylstyrene, vinyltoluene, ethyl vinylbenzene, divinylbenzene, and the like (g) Vinyl compounds having a heterocyclic ring such as triallyl isocyanurate, triallyl cyanurate, and vinylpyridine (h) Vinyl cyanide compounds such as methacrylonitrile and α-chloroacrylonitrile, acrolein, formylstyrol, vinyl methyl ketone, vinyl ethyl ketone, and vinyl butyl ketone.

As the "ester of the monocarboxylic acids" of the above-described (c), the following substances are listed:

alkyl esters of methacrylic acid such as methyl methacrylate, ethyl methacrylate, n-propyl methacrylate, i-propyl methacrylate, n-butyl methacrylate, i-butyl methacrylate, n-pentyl methacrylate, i-pentyl methacrylate, n-hexyl methacrylate, cyclohexyl methacrylate, 2-ethylhexyl methacrylate, octyl methacrylate, i-nonyl methacrylate, tert-butyl cyclohexyl methacrylate, decyl methacrylate, dodecyl methacrylate, hydroxymethyl methacrylate; hydroxyethyl methacrylate amino alkyl esters of acrylic acid such as aminoethyl acrylate, dimethylaminoethyl acrylate, butylaminoethyl acrylate, and the like;

methacrylate having an aromatic ring such as benzyl methacrylate, benzoyl methacrylate, allyl methacrylate, and the like;

methacrylate having an epoxy group such as glycidyl methacrylate, methaglycidyl methacrylate, epoxycyclohexyl methacrylate, and the like; and methacrylate having functional groups such as N-methylolmethacrylamide, γ-methacryloxypropyltrimethoxysilane;

methacrylate having a polyfunctional group such as ethylene glycol dimethacrylate, trimethylolpropane trimethacrylate, and the like.

As the "esters of dicarboxylic acids" of the above-described (c), half esters such as methyl maleate, methyl itaconate; diallyl phthalate, diallyl itaconate, and the like are listed.

As the "anhydrides of the unsaturated carboxylic acids" of the above-described (c), anhydride of acrylic acid, anhydride of maleic acid, and the like are listed.

As the "metal salts" of the above-described (d), aluminum salts, calcium salts, zinc salts, and magnesium salts of unsaturated carboxylic acids such as acrylic acid, methacrylic acid, maleic acid, and fumaric acid are listed.

As the ethylene unsaturated monomer that can be preferably used in the present invention, the following substances are listed:

methacrylic acid;

higher ester of methacrylic acid such as trimethylolpropane trimethacrylate (TMPT), ethylene dimethacrylate (EDMA), polyethylene glycol dimethacrylate, cyclohexyl methacrylate, allyl methacrylate, tetrahydrofurfuryl methacrylate, and isobutylene ethylene dimethacrylate;

metal salts of methacrylic acid or acrylic acid such as aluminum acrylate, aluminum methacrylate, zinc acrylate, zinc methacrylate, calcium acrylate, calcium methacrylate, magnesium acrylate, magnesium methacrylate, and the like; and triallyl isocyanurate, triallyl cyanurate, diallyl phthalate, diallyl itaconate, vinyl toluene, vinyl pyridine, and divinylbenzene.

As the polyfunctional polymers, those utilizing the functional group of 1,2-polybutadiene are listed. More specifically, Buton 150, Buton 100, polybutadiene R-15, Diene-35, Hystal-B2000, and the like are listed.

As the above-described dioximes, p-quinonedioxime, p,p'-dibenzoyl quinonedioxime, N,N'-m-phenylenebismaleimide, and the like are listed.

The mixing amount of the co-crosslinking agent should be large enough to allow the rubber component to be vulcanized. Thus normally the mixing amount of the co-crosslinking agent is selected from the range of 0.1 to 10 parts by mass for 100 parts by mass of the rubber component.

As the vulcanization accelerator, both inorganic accelerators and organic accelerators can be used.

As the inorganic accelerator, it is possible to use slaked lime, magnesium oxide, titanium oxide, and litharge (PbO).

As the organic accelerator, thiurams, thiazoles, thioureas, dithiocarbamates, guanidines, and sulfeneamides are listed.

As the thiurams, tetramethylthiuram monosulfide, tetramethylthiuram disulfide, tetraethylthiuram disulfide, tetrabutylthiuram disulfide, and dipentamethylenethiuram tetrasulfide are listed.

As the thiazoles, it is possible to list 2-mercaptobenzothiazole, dibenzothiazyl disulfide, N-cyclohexyl benzothiazole, N-cyclohexyl-2-benzothiazolesulfeneamide, N-oxydiethylene-2-benzothiazolesulfeneamide, N-tert-butyl-2-benzothiazolesulfeneamide, and N,N-dicyclohexyl-2-benzothiazolesulfeneamide.

As the thioureas, N,N'-diethylthiourea, ethylenethiourea, and trimethylthiourea are listed.

As the salts of the dithiocarbamates, zinc dimethyl dithiocarbamate, zinc diethyl dithiocarbamate, zinc dibutyl dithiocarbamate, sodium dimethyl dithiocarbamate, sodium diethyl dithiocarbamate, copper dimethyl dithiocarbamate, ferric dimethyl dithiocarbamate (III), selenium diethyl dithiocarbamate, and tellurium diethyl dithiocarbamate are listed.

As the guanidine accelerator, it is possible to list di-o-tolyl guanidine, 1,3-diphenyl guanidine, 1-o-tolylbiguanide, and di-o-tolylbiguanide salts of dicatechol borate.

As the sulfeneamides, N-cyclohexyl-2-benzothiazolyl sulfeneamide and the like are listed.

The mixing amount of the vulcanization accelerator should be large enough to allow the property of the rubber component to be sufficiently displayed. The mixing amount of an inorganic vulcanization accelerator is selected in the range of 0.5 to 15 parts by mass with respect to 100 parts by mass of the rubber component. The mixing amount of an organic vulcanization accelerator is selected in the range of 0.5 to 3 parts by mass with respect to 100 parts by mass of the rubber component.

The vulcanization-accelerating assistant that is used in the present invention includes metal oxides such as zinc white, zinc carbonate, and the like; fatty acids such as stearic acid, oleic acid, cotton seed fatty acid; and known vulcanization-accelerating assistants. The metal oxides such as zinc white also serve as reinforcing agents described below.

The mixing amount of the vulcanization-accelerating assistant should be large enough to allow the property of the rubber component to be sufficiently displayed. Normally the mixing amount of the vulcanization-accelerating assistant is selected in the range of 0.5 to 10 parts by mass with respect to 100 parts by mass of the rubber component.

As the age resistor, amines, phenols, imidazoles, and phosphorus-containing substances, and thioureas are listed.

As the amines, phenyl-α-naphthylamine, 2,2,4-trimethyl-1,2-dihydroquinoline polymer (TMDQ), 6-ethoxy-2,2,4-trimethyl-1,2-dihydroquinoline (ETMDQ), p,p'-dioctyldiphenylamine, p,p'-dicumyldiphenylamine (DCDP), N,N'-di-2-naphthyl-p-phenylenediamine (DNPD), N,N'-diphenyl-p-phenylenediamine (DPPD), N-phenyl-N'-isopropyl-p-phenylenediamine (IPPD), and N-phenyl-N'-1,3-dimethylbutyl-p-phenylenediamine (6PPD) are listed.

The phenols that are used in the present invention includes 2,6-di-tert-butyl-4-methyl phenol (BHT OR DTBMP); styrenated methyl phenol; 2,2'-methylene bis (4-methyl-6-tert-butyl phenol) (MBMBP); 2,2'-methylene bis (4-ethyl-6-tert-butyl phenol); 4,4'-thiobis (3-methyl-6-tert-butyl phenol) (TBMTBP); 4,4'-butylidene bis (3-methyl-6-tert-butyl phenol) (BBMTBP); 2,5-di-tert-butyl hydroquinone (DBHQ); and 2,5-di-tert-amyl hydroquinone (DAHQ).

As the imidazoles, 2-mercaptobenzimidazole (MBI), zinc salts of 2-mercaptobenzimidazole (ZnMBI), and nickel dibutyldithiocarbamate (NiBDC) are listed.

As other age resistors, it is possible to use phosphorus-containing substances such as tris (nonyl phenyl) phosphite (TNPP); thioureas such as 1,3-bis(dimethylaminopropyl)-2-thiourea, tributyl thiourea (TBTU), and the like; and wax for preventing ozone-caused deterioration.

The mixing amount of the age resistor should be large enough to allow the property of the rubber component to be sufficiently displayed. In the present invention, normally the mixing amount of the age resistor is selected in the range of 0.1 to 15 parts by mass with respect to 100 parts by mass of the rubber component. The reason the mixing amount of the age resistor is set to 0.1 to 15 parts by mass with respect to 100 parts by mass of the rubber component is as follows: When the mixing amount of the age resistor is less than 0.1 parts by mass, the effect of the age resistor is not displayed. Thus there is a fear that the resulting thermosetting elastomer composition has an inferior mechanical property and an excessive wear. On the other hand, when the mixing amount of the age resistor exceeds 15 parts by mass, the age resistor is dispersed unfavorably owing to an excessive mixing amount thereof. Thereby there is a fear that the thermosetting elastomer composition has an inferior mechanical property.

It is more favorable that the mixing amount of the age resistor is set to 0.5 to 10 parts by mass with respect to 100 parts by mass of the rubber component.

As the softener for rubber, it is possible to use derivatives of phthalic acid, isophthalic acid, adipic acid, sebacic acid, benzoic acid, and phosphoric acid.

More specifically, it is possible to list dioctyl phthalate (DOP), dibutyl phthalate (DBP), di-(2-ethylhexyl) phthalate, di-iso-octyl phthalate (DIOP), higher alcohol phthalate, di-(2-ethylhexyl) sebacate, polyester adipate, dibutyl diglycol adipate, di(butoxyethoxyethyl) adipate, iso-octyl-tall oil fatty ester, tributyl phosphate (TBP), tributoxyethyl phosphate (TBEP), tricresyl phosphate (TCP), cresyl diphenyl phosphate (CDP), and diphenyl alkane.

The mixing amount of the softener for rubber should be large enough to allow the property of the rubber component to be sufficiently displayed. Normally the mixing amount of the softener is selected in the range of 0.5 to 5 parts by mass with respect to 100 parts by mass of the rubber component.

As the reinforcing agent, in addition to carbon black mainly used as a filler for guiding an interaction of the carbon black with the elastomer, it is possible to use inorganic reinforcing agents such as white carbon (silica filler such as dry silica or wet silica, silicate such as magnesium silicate), calcium carbonate, magnesium carbonate, magnesium silicate, clay (aluminum silicate), silane-modified clay, and talc; and organic reinforcing agents such as coumarone and indene resin, phenol resin, high styrene resin, and wood meal.

It is preferable to use the carbon black because it is excellent in its reinforcing effect, low in cost, dispersibility, and wear resistance. As the carbon black, it is possible to use SAF carbon (average particle diameter: 18 to 22 nm), SAF-HS carbon (average particle diameter: about 20 nm), ISAF carbon (average particle diameter: 19 to 29 nm), N-339 carbon (average particle diameter: about 24 nm), ISAF-LS carbon (average particle diameter: 21 to 24 nm), I-ISAF-HS carbon (average particle diameter: 21 to 31 nm), HAF carbon (average particle diameter: about 26 to 30 nm), HAF-HS carbon (average particle diameter: 22 to 30 nm), N-351 carbon (average particle diameter: about 29 nm), HAF-LS carbon (average particle diameter: about 25 to 29 nm), LI-HAF carbon (average particle diameter: about 29 nm), MAF carbon (average particle diameter: 30 to 35 nm), FEF carbon (average particle diameter: about 40 to 52 nm), SRF carbon (average particle diameter: 58 to 94 nm), SRF-LM carbon, and GPF carbon (average particle diameter: 49 to 84 nm). It is especially preferable to use the FEF carbon, the ISAF carbon, the SAF carbon, and the HAF carbon.

The mixing amount of the reinforcing agent for the rubber component should be large enough to allow the property of the rubber component to be sufficiently displayed. Normally the mixing amount of the reinforcing agent is selected in the range of 5 to 100 parts by mass with respect to 100 parts by mass of the rubber component.

As the above-described additive, an amide compound, metal salts of fatty acids, and wax are listed.

As the amide compounds, an aliphatic amide compound and an aromatic amide compound are listed. The fatty acid of the aliphatic amide compound consists of at least one of fatty acid selected from among oleic acid, stearic acid, erucic acid, caproic acid, caprilic acid, lauryl acid, myristic acid, palmitic acid, arachidic acid, behenic acid, palmitoleic acid, eicosane acid, erucic acid, elaidic acid, trans-11-eicosane acid, trans-13-docosane acid, linolic acid, linolenic acid, and ricinoleic acid are listed. It is also preferable to oleic acid amide, stearic acid amide, erucic acid amide.

The metal salt of the fatty acid consists of at least one fatty acid selected from among lauryl acid, stearic acid, palmitic acid, myristic acid, and oleic acid. The metal of the metal salt consists of at least one metal selected from among zinc, iron, calcium, aluminum, lithium, magnesium, strontium, barium, cerium, titanium, zirconium, lead, and manganese.

As the wax, paraffin wax, montan wax, amide wax are listed.

The mixing amount of these additives should be large enough to allow the property of the rubber component to be sufficiently displayed. In the present invention, the mixing amount of the additives with respect to 100 parts by mass of the rubber component is selected in the range of 1 to 10 parts by mass.

As the crosslinking agent which is used in the present invention, sulfur, organic sulfur-containing compounds, organic peroxides, heat-resistant crosslinking agents, and resin crosslinking agent are listed.

The sulfur is used by pulverizing recovered sulfur to use it in the form of fine powder. Surface-treated sulfur having improved dispersibility can be appropriately used. Insoluble sulfur can be also used to prevent it from blooming from unvulcanized rubber.

As the organic sulfur-containing compounds, N,N'-dithiobismorpholine, diphenyl disulfide, pentabromodisulfide, and the like are listed.

As the organic peroxides, it is possible to list benzoyl peroxide, 1,1-di-(tert-butyl peroxy)-3,3,5-trimethylcyclohexane, 2,5-dimethyl-2,5-di-(benzoyl peroxy)hexane, 2,5-dimethyl-2,5-di-(benzoyl peroxy)-3-hexene, 2,5-dimethyl-2,5-di-(tert-butyl peroxy)hexane, di-tert-butyl peroxy-di-isopropylbenzene, di-tert-butyl peroxide, di-tert-butylperoxybenzoate, dicumyl peroxide, tert-butyl cumyl peroxide, 2,5-dimethyl-2,5-di-(tert-butyl peroxy)-3-hexene, 1,3-bis(tert-butyl peroxyisopropyl)benzene, n-butyl-4,4-bis (tert-butyl peroxy)valerate, p-chlorobenzoyl peroxide, 2,4-dichlorobenzoyl peroxide, tert-butyl peroxide, tert-butyl peroxyisopropyl carbonate, diacetyl peroxide, and lauroyl peroxide.

The heat-resistant crosslinking agent which is used in the present invention includes 1,3-bis(citraconimide methyl) benzene, hexamethylene-1,6-sodium bisthiosulfate-dihydrate, 1,6-bis(dibenzylthiocarbamoyl disulfide)hexane.

As the resin crosslinking agent which is used in the present invention, alkylphenol resin or bromized alkylphenol formaldehyde resin such as TACKROL 201 (produced by Taoka Chemical Co., Ltd.), TACKROL 250-III (produced by Taoka Chemical Co., Ltd.), and Hitanol 2501 (produced by Hitachi Chemical Co., Ltd.) are listed.

The mixing amount of the crosslinking agent should be large enough to allow the property of the rubber component to be sufficiently displayed. It is possible to combine two or more crosslinking agents with each other. In the present invention, the mixing amount of the crosslinking agent with respect to 100 parts by mass of the rubber component is selected in the range of 0.1 to 30 parts by mass.

The cleaning blade of the present invention for use in the image-forming apparatus composed of the thermosetting elastomer composition is obtained by mixing the above-described components with one another by using a rubber kneading apparatus such as a single-screw extruder, a 1.5-axis screw extruder, a twin screw extruder, an open roll, a kneader, a Banbury mixer or a heated roller. The order of mixing the components is not specifically limited, but it is possible to supply the components to the kneading apparatus all together. It is also possible to supply a part of the components to the kneading apparatus, knead them to obtain a mixture, add remaining components to the mixture, and re-perform a kneading operation. It is preferable to carry out a method for kneading the rubber component and the filler to obtain a mixture, add the crosslinking agent to the mixture, and thereafter re-performing a kneading operation.

The cleaning blade of the present invention for use in the image-forming apparatus is obtained by cutting the sheet obtained by molding the thermosetting elastomer composition by using a known molding method such as compression molding or injection molding. The accuracy of the cleaning blade is determined by the ridgeline of the edge of the cleaning blade which is brought into contact with the photoreceptor. Therefore the edge of the cleaning blade of the present invention is cut accurately.

The present invention provides a method for manufacturing a cleaning blade, wherein in forming a ridgeline longitudinally formed on a cleaning blade edge which contacts a photoreceptor by cutting a sheet with a cutting blade, the sheet is stretched in a direction orthogonal to a direction in which the cutting blade is moved to allow the sheet to generate a tensile strain (mm) not less than 0.01 nor more than 1.0 or/and a tensile stress (MPa) not less than 0.01 nor more than 5.0.

More specifically, upper and lower sides of the sheet are fixed to holding jigs with both lateral ends of the sheet bonded to a holder. Thereafter the holding jigs are moved in separation directions to stretch the sheet toward both lateral ends thereof so that the tensile strain and the tensile stress are applied to the sheet. In this state, to cut the sheet to form the ridgeline, the cutting blade is moved at a high speed in the longitudinal direction of the sheet interposed between the holding jigs disposed at both sides of the sheet with the cutting blade kept vertical to the sheet.

By cutting the sheet to form the ridgeline with the stretching load being applied to the sheet, it is possible to prevent an excessive load from being generated and hence the cutting blade from vibrating. Further it is possible to prevent the side face of the cutting blade and the sheet from being rubbed each other and thereby prevent the ridgeline from being damaged. The cleaning blade manufactured in this manner has a high-accuracy ridgeline. Further because the side face of the cutting blade and the rubber sheet rub little each other, it is possible to prevent the cutting blade from being damaged or its performance from deteriorating, keep the ridgeline-forming accuracy of the cutting blade high, and prolong the life of the cutting blade. Thereby it is possible to decrease a replacement frequency of the cutting blade and enhance the production efficiency of the cleaning blade.

The lower limit of the tensile strain of the sheet when the sheet is cut to form the ridgeline is set to 0.01 mm for the following reason: If the tensile strain of the sheet is below 0.01 mm, a small tensile stress is applied to the rubber sheet. Thus there is a fear that a friction force is generated on the section of the rubber sheet and the cutting blade. The upper limit of the tensile strain of the sheet is set to 11.0 mm for the following reason: If the tensile strain of the sheet is above 1.0 mm, an excessive tensile stress is generated on the rubber sheet. As a result, the holder and the rubber sheet bonded thereto are separated from each other, and a stress concentration occurs on the rubber sheet. Thus there is a fear that the ridgeline is formed at a low accuracy.

It is more favorable that the tensile strain is set to not less than 0.05 mm nor more than 0.8 mm.

The tensile strain is set according to a movement distance of the jigs which fix the rubber sheet thereto when the jig is moved horizontally. The movable range of the jig is set by a micro-gauge. The tensile strain is measured in the range from 0.1 mm to 1.0 mm by reading a scale of the micro-gauge. The both-side holding jigs should be so set that the cutting blade is capable of passing through the interval therebetween. But it is favorable the interval is as narrow as possible. It is favorable that the interval is set to 1 to 10 mm. If the interval is below 1 mm, the cutting blade is incapable of passing through the interval therebetween. If the interval is above 10 mm, the rubber sheet flexes and hence cannot be cut accurately. It is more favorable that the interval is set to 1 to 5 mm.

The lower limit of the tensile stress of the sheet is set to 0.01 MPa for the following reason: If the tensile stress of the sheet is below 0.01 MPa, a small tensile stress is applied to the rubber sheet. Thus there is a fear that a friction force is generated on the section of the rubber sheet and the cutting blade. The upper limit of the tensile stress of the sheet is set to 5.0 MPa for the following reason: If the tensile stress of the sheet is above 5.0 MPa, an excessive tensile stress is generated on the rubber sheet. As a result, the holder and the rubber sheet bonded thereto are separated from each other, and a stress concentration occurs on the rubber sheet. Thus there is a fear that the ridgeline is formed at a low accuracy.

It is more favorable that the tensile stress is set to not less than 0.01 MPa nor more than 3.0 MPa.

When the rubber sheet is stretched in cutting it to form the ridgeline, the sheet should be so stretched as to satisfy the above-described condition of the tensile strain or/and the above-described condition of the tensile stress.

To measure the tensile stress, a load cell is horizontally mounted on the jigs which fix the rubber sheet thereto from above and below. A stress sensed by the stretched load cell is read.

It is favorable to set the moving speed of the cutting blade to not less than 500 mm/second nor more than 2500 mm/second. The lower limit of the cutting speed is set to 500 mm/second is for the following reason: If the cutting speed is set lower than 500 mm/second, an elastic deformation of the rubber is generated before the rubber sheet is cut and hence there is a fear that the roughness degree of the ridgeline and the straightness degree thereof become deteriorated. On the other hand, if the cutting speed is set higher than 2500 mm/second, vibration of a motor adversely affects a ridgeline-cutting operation, and a great shock is applied to the cutting blade. Thus there is a fear that the cutting blade is chipped or broken. It is more favorable to set the moving speed of the cutting blade to not less than 1000 mm/second nor more than 2000 mm/second.

It is favorable to set an angle of the cutting blade to not less than 5° nor more than 80°.

The reason the lower limit of the angle of the cutting blade is set to 5° is as follows: If the angle of the cutting blade is below 5°, the cutting blade is incapable of cutting the entire thickness of the rubber sheet, and the cutting blade flexes the rubber sheet convexly downward. Thus there is a fear that the cutting blade is incapable of cutting the rubber sheet to form the ridgeline. The reason the upper limit of the angle of the cutting blade is set to 80° is as follows: If the angle of the cutting blade is as large as 80°, the cutting blade collides with the section of the rubber sheet at an angle close to 90 degrees. As a result, the rubber is subjected to a large load and deforms. Consequently there is a fear that the cutting blade is incapable of cutting the rubber sheet precisely.

It is more favorable to set the angle of the cutting blade to not less than 8° nor more than 50°.

The effect of the present invention is described below. As described above, the cleaning blade of the present invention for use in the image-forming apparatus is small in the degree of the roughness degree of the ridgeline and the straightness degree thereof. Thus the cleaning blade is excellent in the performance of cleaning not only the conventional pulverized toner but also the small-diameter toner and the spherical polymerized toner. Further in the test of supplying 150000 sheets of paper conducted by mounting the cleaning blade on the image-forming apparatus, the sectional length Ws45 of the wear surface of the edge, inclined at 45 degrees, which contacts the photoreceptor is set to not more than 50 μm, and the change rate ΔRe of the average roughness degree value Re of the ridgeline longitudinally formed on the edge is set to not more than +0.7. Therefore after 150000 sheets of paper are supplied to the image-forming apparatus, the cleaning blade has a smaller degree of wear and a smaller degree of change of rate in the average roughness degree value than the conventional cleaning blade composed of polyurethane rubber. That is, the cleaning blade of the present invention is superior to the conventional cleaning blade in its cleaning performance.

In the cleaning blade of the present invention for use in the image-forming apparatus made of the thermosetting elastomer compositions, the acrylonitrile-butadiene rubber (NBR), the hydrogenated acrylonitrile-butadiene rubber (HNBR), or the acrylonitrile-butadiene rubber into which the carbonyl group is introduced is used as the rubber component. Further the hydrogenated acrylonitrile-butadiene rubber in which zinc methacrylate is finely dispersed is mixed with the rubber component. Therefore the cleaning blade has a high wear resistance and keeps the wear resistance high even after the cleaning blade is used for a long time.

According to the method of the present invention for manufacturing the cleaning blade, the sheet made of the thermosetting elastomer composition is cut to form the cleaning blade of the present invention for use in the image-forming apparatus. In forming the ridgeline of the cleaning blade edge which contacts the photoreceptor by cutting the sheet with the cutting blade, the sheet is cut with the sheet being stretched so that the sheet generates a tensile strain (mm) not less than 0.01 nor more than 1.0 or/and a tensile stress (MPa) not less than 0.01 nor more than 5.0. Therefore it is possible to prevent the cutting blade from generating an excessive stress and friction from occurring between the rubber sheet and the cutting blade. Thereby the present invention provides the cleaning blade having the ridgeline formed at a high accuracy.

DETAILED DESCRIPTION OF THE PREFERRED EMBODIMENTS

The embodiment of a cleaning blade of the present invention for use in an image-forming apparatus will be described below with reference to the drawings.

Initially the first embodiment of the present invention will be described in detail below.

Figure 2:
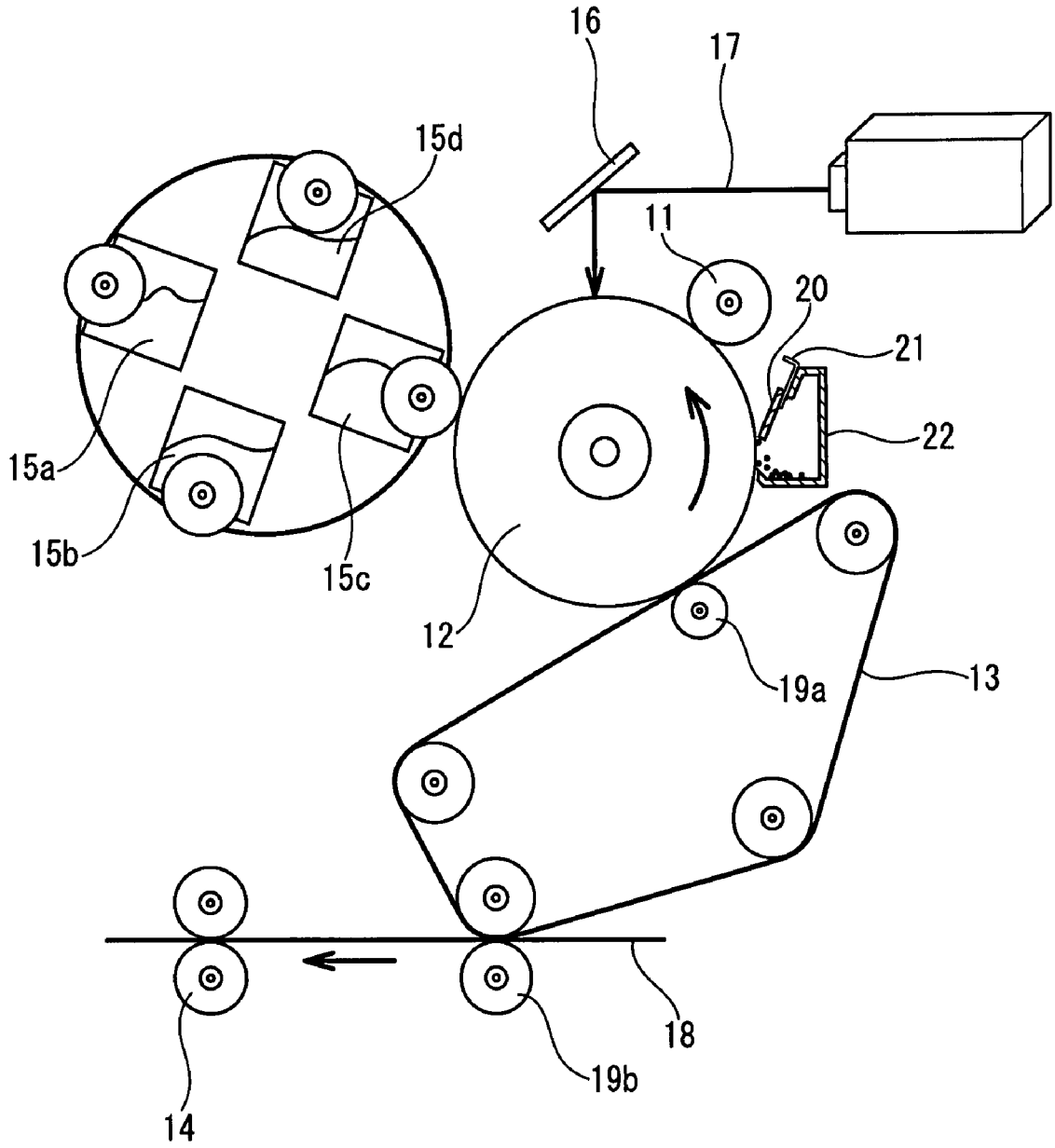
FIG. 2 is an illustrative view showing a color image-forming apparatus where the cleaning blade of the present invention is mounted.

FIG. 2 shows a cleaning blade 20 of the present invention and an image-forming apparatus on which the cleaning blade 20 is mounted.

The cleaning blade 20 is bonded to a supporting member 21 with an adhesive agent. The supporting member 21 is composed of a rigid metal, an elastic metal, plastic or ceramic. It is favorable that the supporting member 21 is made of metal and more favorable that it is made of chrome-free SECC.

As the adhesive agent for bonding the cleaning blade 20 and the supporting member 21 to each other, a polyamide or polyurethane hot-melt adhesive agent and an epoxy or phenol adhesive agent are used. It is preferable to use the hot-melt adhesive agent.

The color image-forming apparatus shown in FIG. 2 forms an image in processes described below:

Initially, a photoreceptor 12 rotates in the direction shown with the arrow of FIG. 2. After the photoreceptor 12 is charged by a charging roller 11, a laser 17 exposes a non-imaging portion of the photoreceptor 12 via a mirror 16, thus destaticizing the non-imaging portion. At this time, the portion of the photoreceptor 12 corresponding to an imaging portion is charged. Thereafter a toner 15*a* is supplied to the photoreceptor 12 and attaches to the charged imaging portion to form a first-color toner image. The toner image is transferred to an intermediate transfer belt 13 via a primary transfer roller 19*a*. In the same manner, a toner image of each of other color toners 15*b* to 15*d* formed on the photoreceptor 12 is transferred to the intermediate transfer belt 13. A full-color image composed of the four color toners 15*a* through 15*d* is formed on the intermediate transfer belt 13. The full-color image is transferred to a to-be-transferred material (normally, paper) 18 via a secondary transfer roller 19*b*. When the to-be-transferred material 18 passes between a pair of a fixing rollers 14 heated to a predetermined temperature, the full-color image is fixed to the surface thereof.

In the above-described processes, to sequentially copy the image of an original document on a plurality of recording paper, toner which has not been transferred to the intermediate transfer belt 13 but has remained on the photoreceptor 12 is removed from the surface of the photoreceptor 12 by rubbing the photoreceptor 12 with a cleaning blade 20 pressed against the surface of the photoreceptor 12 and is collected in a toner collection box 22.

The cleaning blade 20 of the first embodiment of the present invention for use in the image-forming apparatus is formed from a sheet made of a thermosetting elastomer composition essentially containing a rubber component, a filler, and a crosslinking agent.

As the rubber component, it is possible to preferably use acrylonitrile-butadiene rubber (NBR), hydrogenated acrylonitrile-butadiene rubber (HNBR), acrylonitrile-butadiene rubber having a carbonyl group introduced thereinto, or hydrogenated acrylonitrile-butadiene rubber having a carbonyl group introduced thereinto is preferably used. In the first embodiment, moderate high-nitrile acrylonitrile-butadiene rubber having a bound acrylonitrile amount of 35% to 50% is hydrogenated so that it has a residual double bond at not more than 10%.

Further hydrogenated acrylonitrile-butadiene rubber in which zinc methacrylate is finely dispersed to a high extent is mixed with the above-described rubber component. As the hydrogenated acrylonitrile-butadiene rubber in which the zinc methacrylate is finely dispersed to a high extent, it is possible to use a commercially available product. For example, "Zeoforte ZSC series" produced by Zeon Corporation is used.

The hydrogenated acrylonitrile-butadiene rubber (HNBR) in which the zinc methacrylate is finely dispersed to a high extent is mixed at 80 to 120 parts by mass with 100 parts by mass of the rubber component.

As the filler, a co-crosslinking agent, a vulcanization accelerator, a reinforcing agent, and an age resistor are used. The total amount of the fillers is 1 to 80 parts by mass with respect to 100 parts by mass of the rubber component. These fillers can be used singly or in combination of two or more thereof.

As the co-crosslinking agent, methacrylic acid is used. The methacrylic acid is mixed at 5 to 10 parts by mass with respect to 100 parts by mass of the rubber component.

As the vulcanization accelerator, magnesium oxide, thiazoles such as dibenzothiazyl disulfide, thiurams such as tetramethylthiuram monosulfide are used. The thiurams are used in the first embodiment.

0.5 to 15 parts by mass of the magnesium oxide is mixed with 100 parts by mass of the rubber component. 0.5 to 3 parts by mass of the thiazoles or the thiurams is mixed with 100 parts by mass of the rubber component.

As the vulcanization-accelerating assistant, zinc oxide or/and stearic acid are used. 1 to 20 parts by mass of the vulcanization-accelerating assistant is mixed with 100 parts by mass of the rubber component. When two or more kinds of the vulcanization-accelerating assistants are combined with each other, 0.5 to 3 parts by mass of one kind of the vulcanization-accelerating assistants is mixed with 100 parts by mass of the rubber component.

As the reinforcing agent, carbon black is used in the first embodiment. It is preferable to use ISAF carbon. 10 to 80 parts by mass of the ISAF carbon is mixed with 100 parts by mass of the rubber component.

As the age resistor, p,p'-dicumyldiphenylamine and 2-mercaptobenzimidazole are used. The mixing amount of the age resistor is set to 0.1 to 15 parts by mass with respect to 100 parts by mass of the rubber component.

As the crosslinking agent, sulfur, a sulfur-containing compound, an organic peroxide or a resin crosslinking agent is used. These crosslinking agents may be used singly or by mixing two or more of them with each other. The mixing amount of the crosslinking agent is set to 0.5 to 30 parts by mass and favorably 1 to 20 parts by mass with respect to 100 parts by mass of the rubber component.

As the sulfur, it is preferable to use powdery sulfur. The mixing amount of the sulfur is set to 0.1 to 5.0 parts by mass with respect to 100 parts by mass of the rubber component.

As the sulfur-containing compound, it is preferable to use diphenyl disulfide. The mixing amount of the diphenyl disulfide is set to 0.1 to 20 parts by mass with respect to 100 parts by mass of the rubber component.

As the organic peroxide, it is preferable to use dicumyl peroxide. The mixing amount of the organic peroxide is set to 0.5 to 10 parts by mass with respect to 100 parts by mass of the rubber component.

As the resin crosslinking agent, it is preferable to use alkylphenol resin. The mixing amount of the resin crosslinking agent is set to 5 parts by mass to 20 parts by mass with respect to 100 parts by mass of the rubber component.

The thermosetting elastomer composition which is used in the present invention is produced as described below:

Initially the rubber component and the filler are kneaded at 80 to 120° C. for five to six minutes with the kneading apparatus such as the single screw extruder, the 1.5-screw extruder, the twin screw extruder, the open roll, the kneader, the Banbury mixer, and the heated roller. If the kneading temperature is less than 80° C. and the kneading period of time is less than five minutes, the rubber component is insufficiently plasticized and the mixture is insufficiently kneaded. If the kneading temperature is more than 120° C. and the kneading period of time is more than six minutes, there is a fear that the rubber component is decomposed.

After the crosslinking agent is added to the obtained mixture, they are kneaded at 80 to 90° C. for five to six minutes by using the above-described kneading apparatuses. If the kneading temperature is less than 80° C. and the kneading period of time is less than five minutes, the mixture is insufficiently plasticized and kneaded. If the kneading temperature is more than 90° C. and the kneading period of time is more than six minutes, there is a fear that the crosslinking agent is decomposed.

The sheet is formed by molding the thermosetting elastomer composition obtained by carrying out the above-described method.

The molding method is not specifically limited but a known method such as the injection molding or the compression molding can be used. More specifically, press vulcanization is performed at 160° C. to 170° C. for 20 to 40 minutes. If the vulcanizing temperature is less than 160° C. and the vulcanizing period of time is less than 20 minutes, the thermosetting elastomer composition is insufficiently vulcanized. If the vulcanizing temperature is more than 170° C. and the vulcanizing period of time is more than 40 minutes, there is a fear that the rubber component is decomposed.

The sheet is processed to have a thickness of 1 to 3 mm, a width of 10 to 40 mm, and a length of 200 to 500 mm.

In this processing, the ridgeline of the edge of the cleaning blade which contacts the photoreceptor is formed by precisely cutting the sheet by carrying out the following method:

The method of the present invention for forming the ridgeline of the cleaning blade is described below with reference to drawings.

Figure 3A:
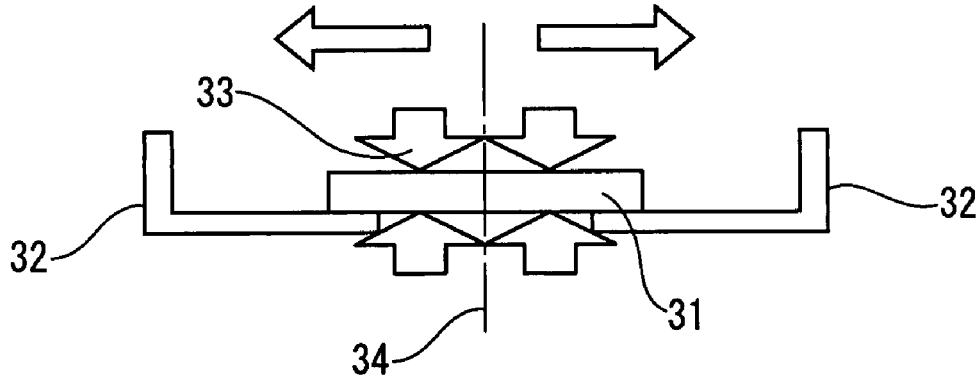
FIG. 3A is a sectional view for explaining a method, for cutting a sheet to form a ridgeline, carried out in examples of the present invention.

As shown in FIG. 3A, two holders 32 are bonded to a sheet 31 obtained by carrying out the above-described method. Thereafter the holders 32 are fixed to the sheet 31 with holding jigs 33 disposed above and below the sheet 31. The holders 32 are bonded to the sheet 31 with a hot-melt adhesive agent, a vulcanization adhesive agent, a two-part mixed adhesive agent, an adhesive tape, a pressure-sensitive tape or adhesive agents commercially available.

In cutting the sheet 31 with a cutting blade 35, the holding jigs 33 are horizontally moved in separation directions as shown with arrows of FIG. 3A so that the sheet 31 generates a predetermined tensile force horizontally. In this state, a cutting portion 34 is cut with a ridgeline-cutting machine manufactured by the present applicant.

As a result of the stretching of the sheet 31, the sheet generates a tensile strain (mm) not less than 0.01 nor more than 1.0 or/and a tensile stress (MPa) not less than 0.01 nor more than 5.0.

Figure 3B:
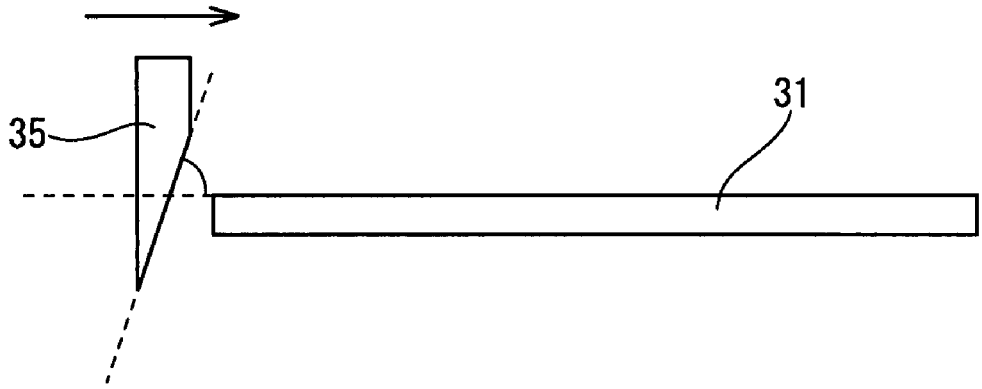
FIG. 3B is a side view for explaining the method, for cutting the sheet to form the ridgeline, carried out in examples of the present invention.

FIG. 3B is a transverse explanatory view for explaining the method for cutting the sheet to form the ridgeline.

The cutting blade 35 is mounted on a ridgeline-forming machine with the cutting blade forming a predetermined angle to the sheet 31. Thereafter the cutting blade 35 is moved in the direction shown with an arrow of FIG. 3B to cut the sheet 31 to form the ridgeline. In the first embodiment, the angle of the cutting blade is set to 8 to 50 degrees. The moving speed of the cutting blade is set to 500 to 2000 mm/second.

In the cleaning blade obtained in this manner, the roughness degree of the ridgeline of the cut side of the sheet is not more than 10 μm, and the straightness degree of the ridgeline is not more than 100 μm.

By cutting the sheet at the above-described accuracy, the cleaning blade is capable of removing the small-diameter toner and the spherical polymerized toner to a high extent.

The cleaning blade obtained in this manner has a tensile strength of 14 to 35 MPa when the cleaning blade is stretched at 300%, a tear strength of 30 to 80N/mm, and a volume swell of 100 to 160%.

The cleaning blade having the above-described properties is excellent in its wear resistance and capable of removing the small-diameter toner and the spherical polymerized toner to a high extent. Thereby after 150000 sheets of paper are supplied to the image-forming apparatus, it is possible to decrease the degree of wear of the edge of the cleaning blade and make the wear of the edge uniform in the longitudinal direction thereof.

The second embodiment of the present invention is described below.

As the rubber component of the thermosetting elastomer composition of the second embodiment, the acrylonitrile-butadiene rubber, the hydrogenated acrylonitrile-butadiene rubber, a mixture of the acrylonitrile-butadiene rubber and the butadiene rubber or a mixture of the acrylonitrile-butadiene rubber and styrene-butadiene rubber is used.

As the acrylonitrile-butadiene rubber, it is preferable to use moderate high-nitrile acrylonitrile-butadiene rubber having a bound acrylonitrile amount in the range of 31% to 35% and high-nitrile acrylonitrile-butadiene rubber having a bound acrylonitrile amount of 36% to 42%.

As the hydrogenated acrylonitrile-butadiene rubber, it is preferable to use hydrogenated moderate high-nitrile acrylonitrile-butadiene rubber having a residual double bond not more than 10%.

When the acrylonitrile-butadiene rubber is combined with the butadiene rubber or the styrene-butadiene rubber, 90 to 50 parts by mass of the acrylonitrile-butadiene rubber is mixed with the total mass, namely, 100 parts by mass of the rubber component.

As the rubber component, it is most favorable to use the hydrogenated acrylonitrile-butadiene rubber having the residual double bond not more than 10%.

Other constructions and effect of the second embodiment are similar to those of the first embodiment. Therefore the description thereof is omitted herein.

EXAMPLES

Examples of the present invention and comparison examples are described below.

Examples 1 Through 6 and Comparison Examples 1

After the mixing amount of each of the rubber component (1), the filler (2), and the hydrogenated acrylonitrile-butadiene rubber in which the zinc methacrylate is finely dispersed to a high extent shown in table 1 was measured, they were supplied to a rubber kneading apparatus such as a twin screw extruder, an open roll or a Banbury mixer. Thereafter they were kneaded for five to six minutes while they were being heated at 80° C. to 120° C.

The obtained mixture and the crosslinking agent (3) were supplied to the rubber kneading apparatus such as the open roll, the Banbury mixer or the kneader. The mixing amount of the crosslinking agent (3) is shown in table 1. Thereafter they were kneaded for five to six minutes while they were being heated to 80° C. to 90° C.

After the obtained rubber composition was set in a die, it was press-vulcanized at 160° C. for 30 minutes to obtain a sheet having a thickness of 2 mm. After a cleaning blade having a width of 27 mm and a length of 320 mm was cut out of the sheet having the thickness of 2 mm, the cleaning blade was bonded to a supporting member made of chrome-free SECC with hot-melt made of diamond. The central portion of the sheet was cut to obtain a cleaning member.

TABLE 1

| | | Example | | | | | | Comparison |
|---|---|---|---|---|---|---|---|---|
| | | 1 | 2 | 3 | 4 | 5 | 6 | example 1 |
| Rubber component (1) | Urethane rubber | | | | | | | 100 |
| | NBR | 100 | 100 | | | | | |
| | H-NBR | | | 100 | 100 | 45 | 45 | |
| Filler (2) | Carbon black | 15 | 50 | 50 | | | | |
| | Methacrylic acid | 10 | | | 20 | | | |
| | Zinc oxide | 10 | 5 | 5 | 20 | | 5 | |
| | Stearic acid | | 1 | 1 | | | 5 | |
| | Age resistor A | 1 | 1 | 1 | 1 | 1 | 1 | |
| | Age resistor B | 2 | 2 | 2 | 2 | 2 | 2 | |
| | Vulcanization accelerator A | | 1.5 | 1.5 | | | | |
| | Vulcanization accelerator B | | 0.5 | 0.5 | | | | |
| Crosslinking agent (3) | Sulfur | | 1.5 | 1.5 | | | | |
| | Sulfur-containing compound | | | | | 0.5 | 0.5 | |
| | Organic peroxide | 3 | | | 3.0 | 3.6 | 4 | |
| ZDMA-containing HNBR (4) | Zeoforte ZSC | | | | | 55 | 55 | |
| Tensile strength (MPa) | | 14 | 26 | 28 | 27 | 30 | 34 | 13 |
| Tear strength (N/mm) | | 30 | 70 | 52 | 78 | 60 | 78 | 22 |
| Volume swell | | 106 | 139 | 159 | 123 | 121 | 155 | 83 |
| Ws45 (μm) | | 36 | 45 | 48 | 39 | 25 | 27 | 55 |
| Roughness degree of ridgeline ΔRe | | 0.66 | 0.17 | −0.33 | −0.19 | −0.31 | −0.07 | 0.83 |
| Cleaning performance | | 0.50 | 0.32 | 0.41 | 0.35 | 0.32 | 0.32 | 0.72 |

The unit of the mixing amount of each of the rubber component (1), the filler (2), the crosslinking agent (3), and the acrylonitrile-butadiene rubber (4) in which the zinc methacrylate is finely dispersed to a high extent shown in table 1 is part by mass.

The following products were used for the components shown in table 1:

Urethane rubber: Urethane rubber commercially available (hardness: 75A)

NBR (acrylonitrile-butadiene rubber): "N232S (commercial name)" produced by JSR Corporation (bound acrylonitrile amount: 35%)

HNBR (hydrogenated acrylonitrile-butadiene rubber): HNBR is used as the base polymer of the rubber component (1) ("Zeptol 2010H (commercial name)" produced by Zeon Corporation, bound acrylonitrile amount: 35%, Mooney viscosity: 145)

Carbon black: "SEAST ISAF (commercial name)" produced by Tokai Carbon Co., Ltd.

Methacrylic acid: "MAA (commercial name)" produced by Mitsubishi Rayon Co., Ltd.

Zinc oxide: "Two kinds of zinc oxide (commercial name)" produced by Mitsui Mining and Smelting Co., Ltd.

Stearic acid: "Tsubaki (commercial name)" produced by NOF CORPORATION

Age resistor A (p,p'-dicumyldiphenylamine): "NOCRAC CD (commercial name)" produced by Ouchishinko Chemical Industry Co., Ltd.)

Age resistor B (2-mercaptobenzimidazole): "NOCRAC MB (commercial name)" produced by Ouchishinko Chemical Industry Co., Ltd.)

Vulcanization accelerator A (dibenzothiazyl disulfide): "Nocceler DM (commercial name)" produced by Ouchishinko Chemical Industry Co., Ltd.)

Vulcanization accelerator B (tetramethylthiuram monosulfide): "Nocceler TS (commercial name)" produced by Ouchishinko Chemical Industry Co., Ltd.)

Sulfur: powdery sulfur produced by Tsurumi Chemical Industry Co., Ltd.

Sulfur-containing compound (diphenyl disulfide): "DPDS (commercial name)" produced by Sumitomo Seika Chemical Co., Ltd.

Organic peroxide (dicumyl peroxide): "Percumyl D (commercial name)" produced by NOF CORPORATION Zeoforte ZSC: "Zeoforte ZSC 2195H (commercial name)" produced by Zeon Corporation The properties shown in tables 1 through 3 were measured by the same method as that described above.

(1) Tensile strength: A dumbbell specimen No. 3 was made by punching a prepared sheet having a thickness of 2 mm to measure the tensile strength thereof at a stress rate of 500 mm/minute in accordance with JIS K 6251.

(2) Tear strength: An angle specimen was made by punching a prepared sheet having a thickness of 2 mm to measure the tear strength thereof in accordance with JIS K 6252.

(3) Volume swell: The volume swell of a specimen sheet having a dimension of 20 mm×20 mm×2 mm was computed by means of toluene swelling at 40° C. for 24 hours in accordance with JIS K 6258.

Figure 1A:
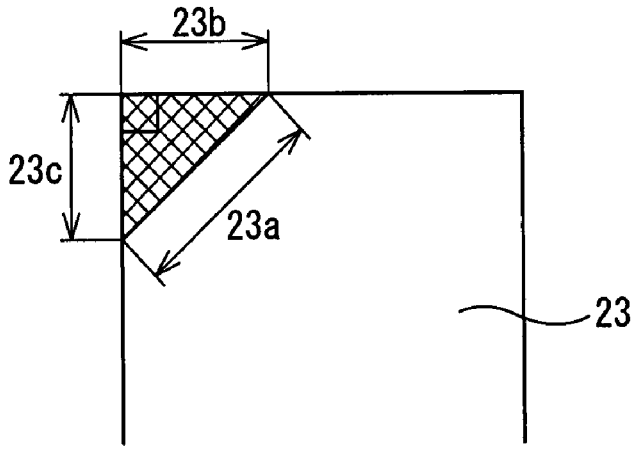
FIG. 1A is an explanatory view for explaining a sectional length Ws of a wear surface of a cleaning blade.
Figure 1B:
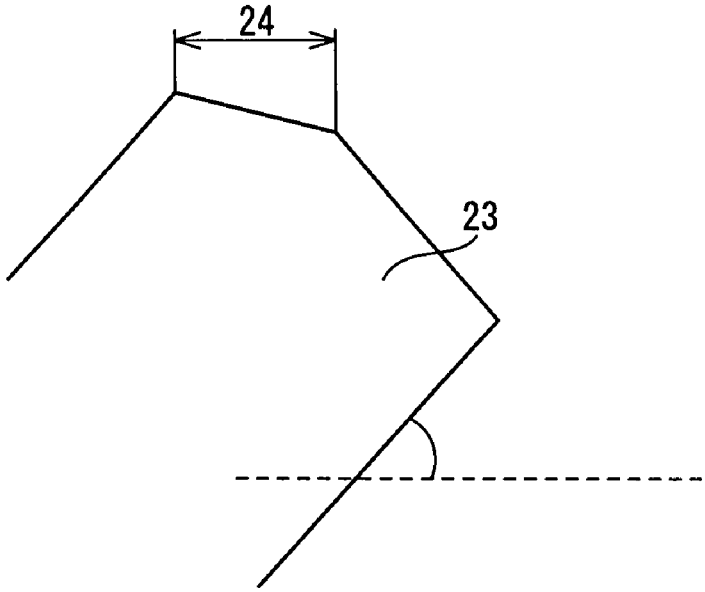
FIG. 1B is an explanatory view for explaining a sectional length Ws45 of the wear surface of the cleaning blade.

(4) Evaluation of Wear Resistance:

Each of the cleaning blades 23 made in the examples and the comparison examples by punching the sheet having a thickness of 2 mm and an appropriate size was bonded to a supporting member. Each cleaning blade 23 was mounted on an image-forming apparatus (printer commercially available) having a rotating photoreceptor. An original document was printed on 150,000 sheets of paper by the image-forming apparatus in which the photoreceptor rotated at 200 mm/second to 500 mm/second. The printing concentration was 4%. Thereafter the edge of each cleaning blade was observed. As shown in FIG. 1B, the sectional length Ws45 (24) of the wear surface of the rubber of the cleaning blade was measured as a horizontal distance of the sectional length Ws of the wear surface of the rubber thereof when the edge thereof inclined at 45 degrees. The wear resistance of each cleaning blade 23 was measured based on the sectional length Ws45 (24). The test was conducted at a normal temperature of 23° C. and a relative humidity of 55%.

(5) Change of rate of average value Re of roughness degree of ridgeline: By using the ridgeline-examining apparatus, the edge of a molded product was scanned at an angle of 45° by a CCD camera. The difference between the dimension of convexities formed on the ridgeline and that of concavities formed thereon was computed for each 1 mm of the edge of the cleaning blade by means of image processing. The roughness degree of the ridgeline having the length of 326 mm was determined from the average value of 326 data of the difference between the dimension of the convexities and that of the concavities. The change rate ΔRe of the average roughness degree value Re of the ridgeline was computed from an average roughness degree value Re' of the ridgeline by using the condition equation after 150000 sheets of paper was supplied to the image-forming apparatus. The ridgeline-examining apparatus was manufactured by the present applicant.

(6) Evaluation of Cleaning Performance:

Each of the cleaning blades 23 made in the examples and the comparison examples by punching the sheet having a thickness of 2 mm and an appropriate size was bonded to the supporting member. Each cleaning blade 23 was mounted on an image-forming apparatus (manufactured by the present applicant) having a rotating photoreceptor. After the amount of toner supplied to the photoreceptor per unit area was computed (toner amount Ta before toner passed cleaning blade without being removed by cleaning blade), the photoreceptor was rotated to remove the toner by the cleaning blade. Thereafter the amount of the toner (toner amount Tb after toner passed cleaning blade without being removed by cleaning blade) present on the surface of the photoreceptor disposed rearward from the cleaning blade was converted into an amount per unit area of the photoreceptor. Thereafter a value indicating the cleaning performance was evaluated from the condition equation. The test was conducted at a normal temperature of 23° C. and a relative humidity of 55%.

As shown in table 1, in each of the cleaning blades of the examples 1 through 6, the sectional length Ws45 of the wear surface of the edge was not more not more than 50 μm, and the change rate ΔRe of the roughness degree of the ridgeline was not more than 0.5.

As indicated in table 1, the cleaning blade of the comparison example 1 made of polyurethane was inferior to the cleaning blades of the examples 1 through 6 in the wear resistance, change rate ΔRe of the roughness degree of the ridgeline, and cleaning performance thereof.

Examples 7 through 10 of the present invention and comparison Examples 2 through 4 are described below.

The unit of the mixing amount of each of the rubber component (1), the filler (2), and the crosslinking agent (3) shown in table 2 is part by mass.

Examples 7 Through 10 and Comparison Examples 2 Through 4

After the mixing amount of 100 parts by mass of the NBR serving as the rubber component (1) and the mixing amount of the filler (2), namely, 50 parts by mass of the carbon black, 10 parts by mass of the methacrylic acid, and 10 parts by mass of the magnesium oxide were measured, they were supplied to a rubber kneading apparatus such as a twin screw extruder, an open roll or a Banbury mixer. Thereafter they were kneaded for five to six minutes while they were being heated at 80° C. to 120° C.

The obtained mixture and 3 parts by mass of dicumyl peroxide serving as the crosslinking agent (3) were supplied to the rubber kneading apparatus such as the open roll, the Banbury mixer or the kneader. Thereafter they were kneaded for five to six minutes while they were being heated to 80° C. to 90° C.

After the obtained rubber composition was set in a die, it was press-vulcanized at 160° C. for 30 minutes to obtain sheets each having a thickness of 2 mm.

By using the method of the above-described embodiments, as shown in table 2, the sheets were formed into cleaning blades by cutting the central portion thereof. The cleaning blades were so made as to generate different tensile strains or/and tensile stresses. The moving speeds of the cutting blade and angles thereof were also differentiated respectively in the cleaning blades.

TABLE 2

| | Example | | | | Comparison example | | |
|---|---|---|---|---|---|---|---|
| | 7 | 8 | 9 | 10 | 2 | 3 | 4 |
| Tensile strain (mm) | 0.01 | 0.01 | 1.0 | 1.0 | 0.0 | 1.1 | 1.1 |
| Tensile stress (MPa) | 0.01 | 0.01 | 5.0 | 5.0 | 0.0 | 6.0 | 6.0 |
| Moving speed of cutting blade (mm/sec) | 500 | 2000 | 2000 | 2000 | 400 | 400 | 3000 |
| Angle of cutting blade (°) | 50 | 50 | 50 | 8 | 85 | 4 | 4 |
| Roughness degree of ridgeline | 8.7 | 6.5 | 4.2 | 3.2 | 13 | 11 | 18 |

TABLE 2-continued

| | Example | | | | Comparison example | | |
|---|---|---|---|---|---|---|---|
| | 7 | 8 | 9 | 10 | 2 | 3 | 4 |
| (μm) | | | | | | | |
| Straightness degree (μm) | 92 | 87 | 84 | 72 | 230 | 182 | 128 |
| Cleaning performance | ○ | ○ | ○ | ◎ | X | X | X |

The following products were used for the components used in the examples 7 through 10 and the comparison examples 2 through 4:

NBR (acrylonitrile-butadiene rubber): "N232S (commercial name)" produced by JSR Corporation (bound acrylonitrile amount: 35%)

Carbon black: "SEAST ISAF (commercial name)" produced by Tokai Carbon Co., Ltd.

Methacrylic acid: "MAA (commercial name)" produced by Mitsubishi Rayon Co., Ltd.

Magnesium oxide: "150ST (commercial name)" produced by Kyowa Chemical Industry Co., Ltd.

Dicumyl peroxide (organic peroxide): "Percumyl D (commercial name)" produced by NOF CORPORATION The properties described in table 2 were measured by the same method as that described above. More specifically:

(7) Roughness degree of ridgeline: By using the ridgeline-examining apparatus, the edge of a molded product was scanned at an angle of 45° by a CCD camera. The difference between the dimension of convexities formed on the ridgeline and that of concavities formed thereon was computed for each 1 mm of the edge of the cleaning blade by means of image processing. The roughness degree of the ridgeline having the length of 326 mm was determined from the average value of 326 data of the difference between the dimension of the convexities and that of the concavities. The ridgeline-examining apparatus was manufactured by the present applicant.

(8) Straightness degree: By using the ridgeline-examining apparatus, the straightness degree was determined from 326 data obtained at each 1 mm of the ridge line, having the length of 326 mm, which was formed on the edge in the longitudinal direction thereof.

Figure 4:
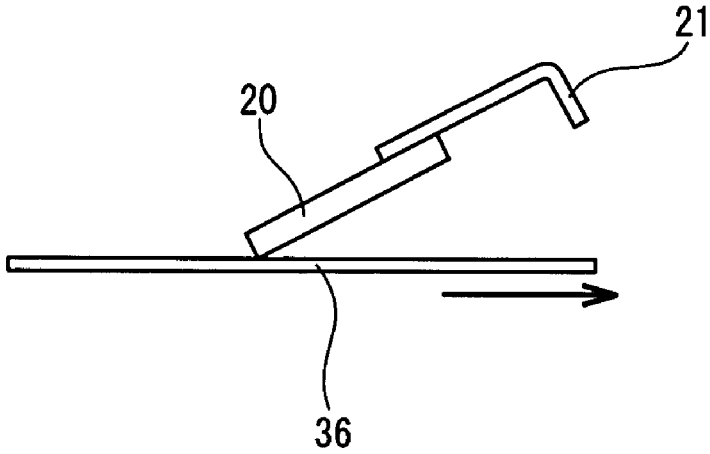
FIG. 4 explains a method, for examining the cleaning performance of the cleaning blade, carried out in examples of the present invention.
Figure 5:
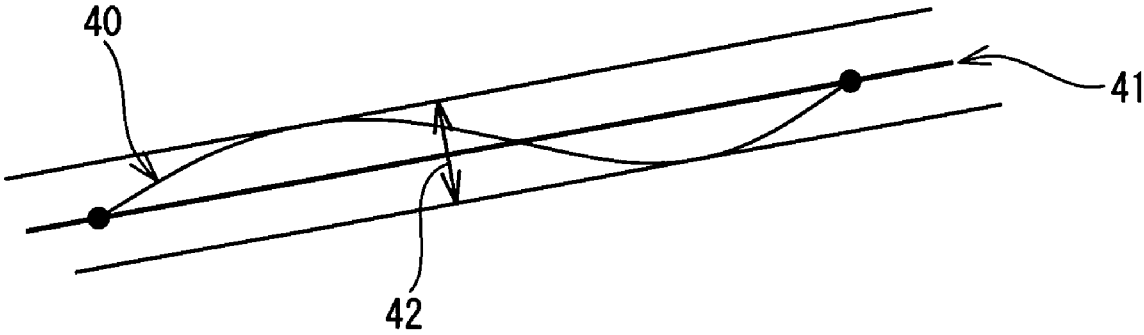
FIG. 5 explains a method for measuring the straightness degree of the ridgeline.

(9) Evaluation of cleaning performance: As shown in FIG. 4, the small-diameter toner and the spherical polymerized toner (toner taken out from commercially available printers manufactured by Canon Co., Ltd. and Fuji Xerox Co., Ltd.) were attached to a horizontally placed glass 36 to which OPC (Organic Photo Conductor) was applied. Each of the cleaning blades 20 made in the examples and the comparison examples was bonded to a supporting member 21 to hold the cleaning blade 20 thereon at an angle of 20 to 40 degrees with respect to the glass 36. In this state, the cleaning blade 20 was slid on the glass 36 at 200 mm/second to observe to what extent the toner was scraped. The test was conducted at a normal temperature of 23° C. and a relative humidity of 55%.

In table 2, the cleaning blade which removed the toner perfectly was marked by ◎. The cleaning blade which removed the toner favorably was marked by ○. The cleaning blade which left a slight amount of the toner on the photoreceptor was marked by Δ. The cleaning blade which left the toner on the photoreceptor to such an extent that the toner was visual was marked by x. The test was conducted at a normal temperature of 23° C. and a relative humidity of 55%.

As shown in table 2, the cleaning blades obtained by cutting the sheet in the conditions of the examples 7 through 10 had the roughness degree of the ridgeline at not more than 10 μm and the straightness degree of the ridgeline at not more than 100 μm. Further the cleaning performance of each of the cleaning blades was marked by ○. That is, they had favorable cleaning performance. Above all, the cleaning blade of the example 10 had the roughness degree of the ridgeline at 3.2 μm and the straightness degree of the ridgeline at 72 μm. Furthermore the cleaning performance thereof was marked by ◎. That is, it had the most favorable cleaning performance.

On the other hand, the cleaning blades obtained by cutting the sheet in the conditions of the comparison examples 2 through 4 had the roughness degree of the ridgeline and the straightness degree thereof inferior to those of the cleaning blades of the examples 7 through 10. Further the cleaning performance of each of the cleaning blades was marked by x. That is, it was confirmed that they had cleaning performance inferior to those of the cleaning blades of the examples 7 through 10.

What is claimed is:

1. A cleaning blade, for use in an image-forming apparatus, for removing toner which remains on a surface of a photoreceptor drum thereof, with said cleaning blade in contact with said photoreceptor drum, wherein said cleaning blade is formed from a sheet composed of a thermosetting elastomer composition;

a roughness degree of a ridgeline formed longitudinally on a cleaning blade edge which contacts said photoreceptor is set to not more than 10 μm, and a straightness degree of said ridgeline is set to not more than 100 μm; and in a test of supplying 150,000 sheets of paper conducted by mounting said cleaning blade on said image-forming apparatus, a change rate ΔRe of an average roughness degree value Re of said ridgeline formed longitudinally on said edge is set to not more than +0.7, and a sectional length Ws45 of a wear surface of said edge, inclined at 45 degrees, which contacts said photoreceptor is set to not more than 50 μm.

2. The cleaning blade according to claim 1, wherein a ratio Tb/Ta of an amount of said toner (amount of toner Tb after toner passes cleaning blade) which remains on a unit area of a photoreceptor of said image-forming apparatus after said toner is removed by said cleaning blade to an amount of said toner (amount of toner Ta before toner passes cleaning blade) supplied to said unit area of said photoreceptor is not more than 0.5.

3. The cleaning blade according to claim 1, wherein said thermosetting elastomer composition contains a rubber component, a filler, and a crosslinking agent; and said thermosetting elastomer composition has a tensile strength of 14 to 35 MPa, a tear strength of 25 to 80 N/mm, and a volume swell of 85 to 160%.

4. The cleaning blade according to claim 1, wherein said rubber component of said thermosetting elastomer composition includes one or a mixture of not less than two rubbers selected from among acrylonitrile-butadiene rubber (NBR), acrylonitrile-butadiene rubber into which a carbonyl group is introduced, hydrogenated acrylonitrile-butadiene rubber (HNBR), hydrogenated acrylonitrile-butadiene rubber into which a carbonyl group is introduced, natural rubber (NR), butadiene rubber (BR), styrene-butadiene rubber (SBR), isoprene rubber (IR), butyl rubber (IIR), chloroprene rubber (CR), acrylic rubber (ACM, ANM), epichlorohydrin rubber (ECO), ethylene propylene rubber (EPR), and ethylene-propylene-diene copolymer rubber (EPDM).

5. The cleaning blade according to claim 4, wherein said acrylonitrile-butadiene rubber, said acrylonitrile-butadiene rubber into which said carbonyl group is introduced or said hydrogenated acrylonitrile-butadiene rubber is used as said rubber component is used as said rubber component; and hydrogenated acrylonitrile-butadiene rubber in which zinc methacrylate is finely dispersed or methacrylic acid is mixed with said rubber component.

6. The cleaning blade according to claim 3, wherein 0.1 to 80 parts by mass of said filler and 0.1 to 30 parts by mass of said crosslinking agent are mixed with 100 parts by mass of said rubber component;

said filler consists of one or more kinds of agents selected from among a co-crosslinking agent, a vulcanization accelerator, a vulcanization-accelerating assistant, an age resistor, a softener for rubber, a reinforcing agent, and other kinds of additives; and said crosslinking agent consists of one or more kinds of agents selected from among sulfur, an organic sulfur-containing compound, an organic peroxide, a heat-resistant crosslinking agent and a resin crosslinking agent.

7. A method for manufacturing a cleaning blade according to claim 1, wherein in longitudinally forming a ridgeline on a cleaning blade edge which contacts a photoreceptor of an image-forming apparatus by cutting a sheet with a cutting blade, said sheet is cut with said sheet being stretched in a direction orthogonal to a direction in which said cutting blade is moved to allow said sheet to generate a tensile strain (mm) not less than 0.01 nor more than 1.0 or/and a tensile stress (MPa) not less than 0.01 nor more than 5.0.

8. The method according to claim 7, wherein a moving speed of said cutting blade is set to not less than 500 mm/second nor more than 2500 mm/second.

9. The method according to claim 7, wherein an angle of said cutting blade is set to not less than 5° nor more than 80°.

* * * * *